US005477876A

United States Patent [19]

Moss

[11] Patent Number: 5,477,876

[45] Date of Patent: Dec. 26, 1995

[54] T-POLE SUPPORT FOR FABRIC STRUCTURE

[75] Inventor: C. William Moss, Scottsdale, Ariz.

[73] Assignee: Bill Moss, Inc., Scottsdale, Ariz.

[21] Appl. No.: 192,969

[22] Filed: Feb. 7, 1994

[51] Int. Cl.[6] ..... A45F 1/00

[52] U.S. Cl. ..... 135/97; 135/114; 135/119; 135/115; 135/100

[58] Field of Search ..... 135/114, 119, 135/97, 115, 908, 100

[56] References Cited

U.S. PATENT DOCUMENTS

| | | | |
|---|---|---|---|
| 1,839,076 | 12/1931 | Adams | 135/908 |
| 2,988,096 | 6/1961 | Otto | 135/115 X |
| 3,425,428 | 2/1969 | Schwartz | 135/114 |
| 3,985,148 | 10/1976 | Cadman | 135/68 X |
| 4,340,075 | 7/1982 | Medeiros | 135/114 |
| 4,422,468 | 12/1983 | Wilson | 135/908 X |
| 4,537,210 | 8/1985 | Montgomery | 135/115 X |
| 5,234,011 | 8/1993 | Lynch | 135/114 X |

FOREIGN PATENT DOCUMENTS

| | | | |
|---|---|---|---|
| 1237671 | 6/1960 | France | 135/114 |
| 2500285 | 7/1976 | Germany | 135/114 |
| 1752904 | 8/1992 | U.S.S.R. | 135/114 |

*Primary Examiner*—Wynn E. Wood
*Attorney, Agent, or Firm*—Marshall & Melhorn

[57] ABSTRACT

A lightweight fabric structure is provided with a fabric membrane having a pocket type configuration formed along the center seam of the membrane with a T-shaped center pole positioned in the pocket. The lightweight fabric structure may have one or more pockets and corresponding T-shaped center poles. The pavilion type tent structure includes at least four side poles staked about the periphery of the structure with a flexible fabric membrane in tension between the side poles. The shape and configuration of the panels provide tension distribution over the entire fabric structure. The longitudinal center seam of the fabric membrane carries the maximum force. The T-shaped center poles with pocket configuration facilitates the redistribution of the forces from the point where multiple panels of the membrane converge at a single location.

10 Claims, 1 Drawing Sheet

T-POLE SUPPORT FOR FABRIC STRUCTURE

BACKGROUND OF THE INVENTION

1. Field of the Invention

The invention relates generally to a lightweight tension structure having a unique T-shaped center pole, and in particular, to a pavilion type tent structure having flexible fabric membranes in tension between peripheral arches such that the tension on the membrane may be maintained and adjusted by positioning the T-shaped center pole in a pocket formed in the flexible fabric membrane.

2. Summary of the Related Art

Fabric structures and enclosures are used in a variety of applications. Large fabric domes cover outdoor arenas, shopping malls, swimming pools, tennis courts and other locations having a need for a customized shelter. Specially designed fabric structures may be temporarily or permanently used for fairs, meeting halls, pavilions, barracks, and other similar applications. Smaller tents provide camping and residential shelters.

Fabric structures are also used extensively for commercial awnings and canopies to provide both shelter and promotional benefits to a business entity. In addition to the more traditional uses noted above, fabric structures may also be used for sculptures and other more artistic purposes.

In fabric structures, the proper tension must be maintained on the fabric to accommodate the intended application of such fabric structure. A number of different support structures and tensioning means have been developed to maintain the desired tension in a fabric structure. Most of the smaller or mid-sized fabric structures utilize a center support means with anchored guide lines attached to side supports in order to maintain the structure.

In many fabric structures, it is desirable to reinforce or eliminate the hole and bail ring formed in the membrane for acceptance of a center pole in "point pole" construction. A number of different panels are typically joined at the bail ring, which makes the joint one of the most difficult processes from a manufacturing standpoint and one of the weakest points from a quality perspective. In an effort to minimize fabric overlapping and more easily distribute the tensional forces over the entire membrane, tent manufacturers have been looking for a means to eliminate the bail ring in certain applications.

In U.S. Pat. No. 3,886,961 to Geiger et al, a portable structure utilizes the cooperation of flexible arches as compression members in the structure. The tensioned membrane is provided with stressed cables to brace the arches and form a rigid structure.

U.S. Pat. Nos. 3,909,993 and 4,092,992 to Huddle show additional structures using arched supports and means for making laminated arch members. The supports are forced apart in the crown area of the arch by the use of inclined arches or other tensioning means to support the structure.

A building structure including one polyhyparic surface formed of a continuous tensioned web coupled to structural members along its periphery is disclosed in U.S. Pat. No. 4,584,800 to Burt et al.

U.S. Pat. No. 4,644,706 Stafford et al. teaches a building structure with a transversely tensioned fabric covering. A plurality of arches supported in spaced, vertical positions. A winch is used to tension the corresponding fabric panels.

U.S. Pat. No. 4,880,024 to Brell shows a self supporting tent structure designed primarily for protecting small aircraft. The tent structure includes a special tensioning device to obtain the desired tension on the roof of the tent.

U.S. Pat. No. 4,886,084 to Lawrence et al. shows a panelized fabric-covered structure with removable and replaceable fabric panels, including an expandable frame having a plurality of frame members for holding a fabric panel.

U.S. Pat. No. 4,945,936 shows an umbrella type tent with a collapsible frame. An upper and lower clevis is used to provide a flexible upper section which can conform to the dome of the sheet material forming the tent cover.

A unique apex member is provided for the tent structure in U.S. Pat. No. 4,966,178 to Eichorn. The apex member is secured to each of the tent poles and includes a tensioning member which is moved to a tension position for providing the necessary tension to the tent structure.

SUMMARY OF THE INVENTION

The present invention relates to a portable structure provided with a fabric membrane having a pocket type configuration formed in the center seam of the membrane with a T-shaped center pole positioned in the pocket.

In accordance with the present invention, there is provided a lightweight fabric structure having one or more pockets and corresponding T-shaped center poles. The pavilion type tent structure includes at least four side poles staked about the periphery of the structure with a flexible fabric membrane in tension between the side poles. The shape and configuration of the panels provide tension distribution over the entire fabric structure. The longitudinal center seam of the fabric membrane carries the maximum force. The T-shaped center poles with pocket configuration facilitates the redistribution of the forces from the point where multiple panels of the membrane converge at a single location. Such configuration is also adjustable, which permits shifting of the T-shaped pole in response to wind forces and other means for adjustment.

The preferred embodiment includes a symmetrical, two center pole tent configuration with six ground point connections. In a traditional two center pole configuration, the main panels between the two center poles forms a hyperbolic paraboloid with a predisposed saddle-like configuration. The gores formed along the major seams and the T-shaped configuration of the two center poles facilitate the arching and the curving of the perimeter of the membrane.

An object of the present invention is provide a low cost and easy to assemble shade structure which can be utilized as an outdoor pavilion, pool cover, temporary housing, storage structure, or other similar application. The side poles, the center poles, and the fabric membrane are designed for easy transport, assembly, and disassembly.

An additional object of the present invention is to provide a fabric structure which eliminates the need for a hole and bail ring in the membrane to support a center pole with a point at the top end.

A further object of the present invention is to provide an improved means for distributing the inherent stress found in the membrane where multiple panels converge at a single location. The T-shaped center pole and pocket reduces the number of panel converging at a single point, thereby reducing seam overlapping.

An object of the present invention is to provide a center pole that can be positioned to compensate for wind or other factors which influence the tension on the fabric membrane. The stresses may be distributed and the fabric maintained in proper tension to provide an attractive structure without wrinkles or sagging.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
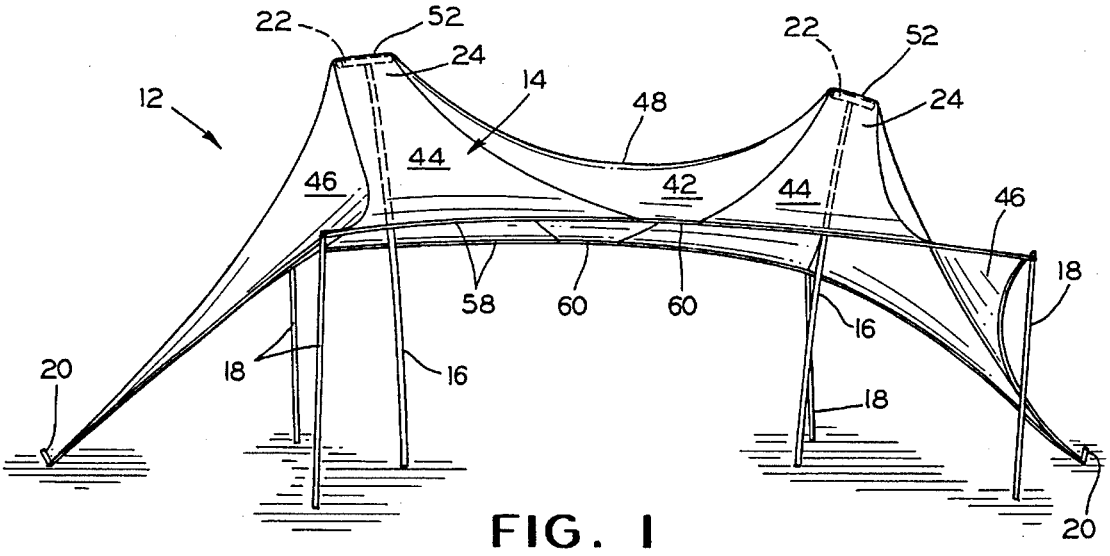
FIG. 1 is a perspective view of a fabric structure according to the present invention comprising T-shaped center poles positioned in pockets in the fabric.

Referring now to the drawings, there is shown in FIG. 1 a fabric structure 12 formed by at four or more side poles 18, one or more center poles 16, and a fabric membrane 14 extending between the side poles 18 and supported by the center poles 16.

In the two center pole configuration shown in FIG. 1, the side poles 18 define the general periphery of the structure 12. The side poles 18 are staked (not shown) to the ground in the normal manner. The fabric membrane includes two ends 20 which are staked to the ground to provide a closed-end structure.

The side poles 18 and the center poles 16 may be made out of various tubular materials, such as aluminum. The top end 30 of the center pole 16 includes a head member 22 which positioned in the pocket-like configuration 24 formed in the fabric membrane 14.

Figure 2:
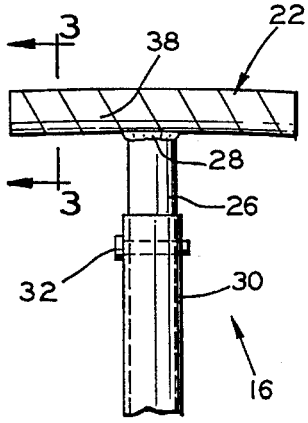
FIG. 2 is a side view of the top of a center pole showing the T-shaped head of the center pole.
Figure 3:
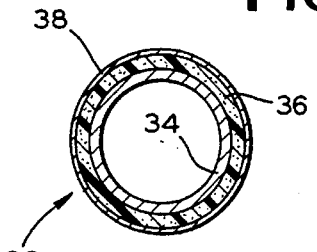
FIG. 3 is a cross-sectional view of the T-shaped head taken along line 3—3 of FIG. 2.

The head member 22, as shown in FIGS. 2 and 3, is a tubular member 34 made from aluminum, steel or other rigid material. A mounting post 26 is welded to the approximate center point 28 of the head member 22.

The mounting post 26, which is inserted into the aperture at the top end 30 of the center pole 16, includes a plurality of mounting holes for the insertion of the retention bolt 32. The head 22 can be adjusted to change the overall length of the center pole 16 merely by sliding the mounting post 26 to the desired position.

The head member 22 may include a naked tubular member 34 or may be padded as shown in FIG. 3. A layer of padding 36 is covered by an adhesive tape material 38. Depending on the type of material used in the fabric membrane, the strength of the wind, and other related factors, the head mender 22 can be covered with a variety of outer coverings to either increase or decrease the slidability of the head member 22 in the pocket 24 of the membrane 14.

The head member is not secured to the pocket 24 in membrane 14 in any manner. The top seam 52 of the pocket 24 is the normal resting point of the head member 22 when the center pole 24 is raised underneath the membrane 14. However, the head member 22 can slide on fabric segment 44 on either side of the pocket 24. If the wind is strong in one direction, the head member will have a tendency to automatically slide in the direction of the wind to maintain the structure 12 in the proper tension.

The center pole 16 can also be manually tilted at a slight angle to shift the head member 22 away from seam 52 to change the normal tension on the structure 12. In a two center pole configuration, such as shown in FIG. 1, the center poles 16 may be positioned independently to vary the configuration of the membrane 14 of the structure 12.

Figure 4:
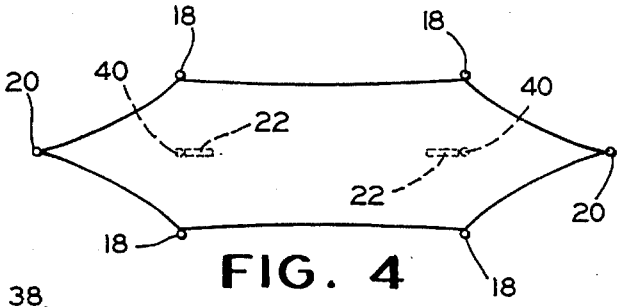
FIG. 4 is a top plan view showing the general perimeter of the fabric structure, plus the side poles and end stakes, as shown in FIG. 1.

In addition to having the ability to shift or adjust the positioning of the center pole 16, the T-shaped center pole 16 also provides several advantages at the points where the various fabric segments converge. FIG. 4 shows the side poles 18 and the head member 22 of center poles 16. Instead of forming a hole 40 in the membrane 14 and inserting a point type center pole as is utilized most frequently in the prior art, the center pole 16 of the present invention provides a better distribution of the tension forces throughout the membrane 14. By increasing the size of the engagement surface between the center pole 16 and the membrane 14, and by retaining the flexibility to adjust or reposition the head 22, the ability to achieve the desired tension and wrinkle free structure 12 is greatly enhanced.

Figure 5:
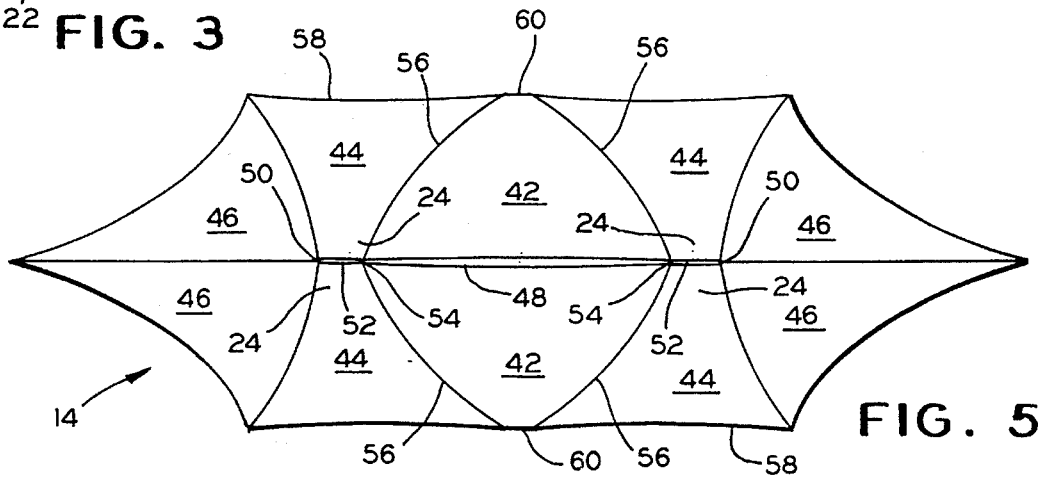
FIG. 5 is a top plan view showing the pattern of the fabric segments combined to form the fabric membrane provided for the structure shown in FIG. 1.

The membrane 14 is made from canvas or other suitable fabric. FIG. 5 provides a top view of the fabric segments used to form the membrane 14 shown in FIG. 1. The hyperbolic paraboloid is formed by the two center segments 82. The opposing corner segments 44 are used to form the two pockets 24 for retaining the center pole 16. When the membrane 14 is in position on the side poles and center poles, the opposing fabric segments 44 are in close proximity along the center seam segment 52. The seam 52 and the two side seams adjacent seam 52 on the opposing segments 44 form a "pocket" to retain the head member 22.

The end pieces 46 complete the fabric segments for the membrane 14.

In this symmetrical configuration, the longitudinal center seam 48 carries the maximum stresses and tension. In a more standard tent design, the stress and tension would be consolidated at point 50 on the center seam 48. Point 50 is where up to six segments would be joined at one point. The substantial seam overlap at the convergence point 50 is one of the quality concerns in pavilion tents of this nature.

By having the head member 22 engage the full seam segment 52, the stress and tension is more evenly distributed. The convergence points 50 and 54 in the present invention only have four segments at each point.

The fabric segments 42, 44 are sewn together to form a gore 48 along the center seam 48 and other internal seams 56. The outer edges 58, 60 are catenary cuts. When the head 22 of the center pole 16 is raised in height and inserted into pocket 24 to extend the membrane 14, the gores 48, 56 facilitate the desired expansion of the fabric segments 42, 44. Instead of comprising a straight line seam, the gore 48, 56 is curved inward such that head member 22 at seam segment 52 is the highest point on the structure 12 and that the tension on the fabric segments 42, 44 is sufficient to raise the outer edges 58, 60 to an acceptable height.

In erecting the structure 12, the membrane is laid out in the area to be covered by the structure 12. Side poles 18 are inserted into the surface and connected to the membrane 14. The center poles 18 are then raised in the center of the membrane 14 in pockets 24. Once the center posts are in an upright position, the side edge 20 can be stretched and secured to the surface at the desired tension.

With the relative configuration of the components thus described, the amount of tension can be adjusted by the positioning of the center pole 18 against the seam segment 52. The center pole 18 can initially be positioned at a slight angle instead of a vertical position. If more tension is desired, the center poles 18 can be moved to a vertical position to increase the tension.

If the wind or other factors cause a shift in the expected tension of the membrane 14, then the head member 22 will slidingly engage surface 44 and adjust to equalize the tension. If the head member 22 does to slide to adjust for whatever reason, or if the shape of the member is to be adjusted, the head member 22 can be moved manually to achieve the preferred positioning and tension on the membrane 14.

In addition to the two center pole configuration discussed above, the structure 12 may be built in a similar manner for one center pole or three or more center poles.

In accordance with the provisions of the patent statutes, the present invention has been described in what is considered to represent its preferred embodiment. However, it should be noted that the invention can be practiced otherwise than a specifically illustrated and described without departing from its spirit or scope.

What is claimed is:

1. A fabric structure adapted to be erected on a support surface to provide shelter, said fabric structure comprising:

a) a plurality of side poles in spaced-apart relationship, said side poles extending vertically from a support surface;

b) a fabric membrane operatively connected to and extending between said plurality of side poles, said fabric membrane including a plurality of fabric segments sewn together along a longitudinal center seam, and including at least one longitudinal pocket area formed along a segment of the center seam in said membrane, the pocket area being defined by a pair of opposing fabric segments sewn together to form the center seam segment and by a fabric convergence point at an end of the center seam segment; and c) at least one T-shaped center pole, said center pole including an elongate pole body and a head member transversely welded to a top end of the pole body, said center pole being positioned under a bottom surface of said membrane and extending generally vertically from the support surface such that the head member is positioned longitudinally in the pocket area and slidingly engages the pocket area, whereby said center pole is retained in the vertical position and the tension forces are distributed over said fabric membrane.

2. The fabric structure defined in claim 1 wherein said T-shaped center poles include a layer of padding secured to the head member.

3. The fabric structure defined in claim 2 wherein the padded head member of said T-shaped center pole includes an additional covering for slidably engaging the pocket area in said fabric membrane.

4. The fabric structure defined in claim 1 wherein the pole body of said T-shaped center pole is a hollow body provided with a top aperture, and the head member of said T-shaped center pole includes a perpendicular mounting post for insertion into the top aperture.

5. The fabric structure defined in claim 4 including a means for adjusting the length of said T-shaped center pole by sliding and securing the mounting post of the head member in the hollow pole body.

6. The fabric structure defined in claim 5 wherein the length of said T-shaped center poles is adjusted so that the membrane is constantly under tension and the plurality of side poles are compressed to obtain a substantially rigid structure.

7. The fabric structure defined in claim 1 wherein the center seam in said fabric membrane includes an inwardly curved gore for expanding said fabric membrane when tension is increased on said fabric membrane by the T-shaped center poles.

8. The fabric structure defined in claim 1 wherein said fabric membrane includes two end piece, said end piece being secured to two of the side poles at opposing ends of the longitudinal center seam, and being secured to the support surface to create the desired tension in said end segments.

9. The fabric structure defined in claim 1 wherein said fabric membrane forms an adjustable hyperbolic paraboloid, said form of said fabric membrane being adjustable by repositioning the head member in the pocket of said fabric membrane.

10. A fabric structure adapted to be erected on a support surface to provide shelter, said fabric structure comprising:

a) a plurality of side poles in spaced-apart relationship, said side poles extending vertically from a support surface;

b) a fabric membrane operatively connected to and extending between said plurality of side poles, said fabric membrane including a plurality of fabric segments sewn together along a longitudinal center seam to provide an inwardly curved gore for expanding said fabric membrane as tension on said fabric membrane is increased, said fabric membrane including at least one longitudinal pocket area formed along a segment of the center seam in said fabric membrane, the pocket area being defined by a pair of opposing fabric segments sewn together to form the center seam segment and by a fabric convergence point at an end of the center seam segment; and c) at least one T-shaped center pole, said center pole including an elongate pole body and a head member transversely welded to a top end of the pole body, said center pole being positioned under a bottom surface of said membrane and extending generally vertically from the support surface such that the head member is positioned longitudinally in the pocket area and slidingly engages the pocket area, whereby said center pole is retained in the vertical position and the tension forces are distributed over said fabric membrane.

* * * * *